United States Patent [19]

Rylander

[11] 4,112,635

[45] Sep. 12, 1978

[54] CHILD'S PLAYHOUSE TYPE COLLAPSIBLE STRUCTURE

[76] Inventor: DeMaris C. Rylander, 4521 E. 55th St., Tulsa, Okla. 75135

[21] Appl. No.: 809,636

[22] Filed: Jun. 24, 1977

Related U.S. Application Data

[63] Continuation of Ser. No. 640,538, Dec. 15, 1975, abandoned.

[51] Int. Cl.[2] ..... E04B 1/344

[52] U.S. Cl. ..... 52/69; 52/70; 217/46; 296/23 H; 296/23 G

[58] Field of Search ..... 52/69, 70, 71, 29, 32, 52/64; 35/60, 62, 63, 64; 46/11, 12; 296/23 H, 23 D, 23 G; 217/12, 12 A, 14, 46; 220/6, 7

[56] References Cited

U.S. PATENT DOCUMENTS

| | | | |
|---|---|---|---|
| 1,335,643 | 3/1920 | Beers | 220/6 |
| 1,917,629 | 7/1933 | Anderson | 52/71 |
| 2,293,569 | 8/1942 | Sonino | 52/71 |
| 2,456,419 | 12/1948 | Jackson | 220/6 |
| 2,456,479 | 12/1948 | Antil | 220/6 |
| 2,670,986 | 3/1954 | Presnell | 296/23 G |
| 3,434,253 | 3/1969 | Hatcher | 52/69 |
| 3,752,349 | 8/1973 | Rana | 217/14 |
| 4,035,965 | 7/1977 | Roinai | 52/69 |

FOREIGN PATENT DOCUMENTS

| | | | |
|---|---|---|---|
| 705,795 | 3/1965 | Canada | 296/23 G |
| 945,435 | 5/1956 | Fed. Rep. of Germany | 220/6 |
| 6,506,543 | 11/1966 | Norway | 217/14 |

*Primary Examiner*—Ernest R. Purser
*Assistant Examiner*—Henry Raduazo
*Attorney, Agent, or Firm*—Head, Johnson & Chafin

[57] ABSTRACT

A child's playhouse, or the like, particularly designed and constructed for being folded into a compact storage position when not in use and readily expandable to a complete playhouse type structure when in use. The structure may be permanently mounted on a wall, or the like, in such a manner that when the apparatus is in the storage position, the entire structure is unobstructive and may be either a decorative feature for the room wherein the apparatus is located, or may be a useful object therein, such as a chalk board, or the like.

8 Claims, 8 Drawing Figures

CHILD'S PLAYHOUSE TYPE COLLAPSIBLE STRUCTURE

This is a continuation of application Ser. No. 640,538, filed Dec. 15, 1975 now abandoned.

BACKGROUND OF THE INVENTION

1. Field of the Invention

This invention relates to improvements in building structures, and more particularly, but not by way of limitation, to a playhouse type structure for children.

2. Description of the Prior Art

Children's playhouses in the form of doll houses particularly designed for use by girls, forts designed for use by boys, castles, and the like, are very popular with children and are in widespread use today. Many of these structures are relatively small for use in conjunction with dolls, and the like. However, other structures of this type are sufficiently large as to permit the children using the apparatus to physically enter the house or building during playtimes, or the like. These structures usually have one particular disadvantage in that the time period during which the child wishes to utilize the structure is frequently limited, and the storage of such a structure when not in use is difficult.

Collapsible type playhouse structures have been developed in order to overcome this disadvantage, such as that shown in the Frank B. King patent issued Feb. 11, 1930, and entitled "Knockdown Playhouse." The collapsible structures available today, however, still have disadvantages since the storage of the collapsed structure is usually awkward, and as a result, when the apparatus is to be used, it is usually inconvenient to find and obtain the collapsed structure in order to erect the playhouse. As a result, the child may be discouraged with regard to using the apparatus.

SUMMARY OF THE INVENTION

The present invention contemplates a collapsible playhouse type apparatus which is particularly designated and constructed for overcoming the foregoing disadvantages. The novel device comprises a main substantially box-like structure which may be substantially permanently mounted on a wall, such as in a child's playroom, basement, garage, or the like, wherein it is most likely that the device will be used. The components or elements of the complete building may be contained with the confines of the box-like structure when the device is not in use, and the exposed outer surface of the box-like structure may become a part of the wall, either as a decorative feature thereof, or a useful object, such as a chalk board, magnetic board, or the like. The entire building is stored readily at hand when not in use, and may be quickly and easily erected for use, and just as readily collapsed against the wall for storage when not in use, thus eliminating the necessity of moving the collapsed packed to another place of storage. The structure includes three walls utilized in conjunction with the portion mounted on the wall wherein a completely enclosed playhouse structure is provided. In addition, a floor is provided in order that the children using the device may play within the structure without damage to the floor or carpeting of the room wherein the device is utilized. A roof structure may also be provided, if desired, as well as suitable windows, doors, and the like, for increasing the practical usefulness of the device for its intended purpose. The contours of the assembled or erected structure may be selected to resemble a home, a castle, a fort, of the like, thus providing a substantially realistic environment for the children during the play time utilizing the device. The entire structure is simple and efficient in operation and economical and durable in construction.

DESCRIPTION OF THE PREFERRED EMBODIMENT

Figure 1:
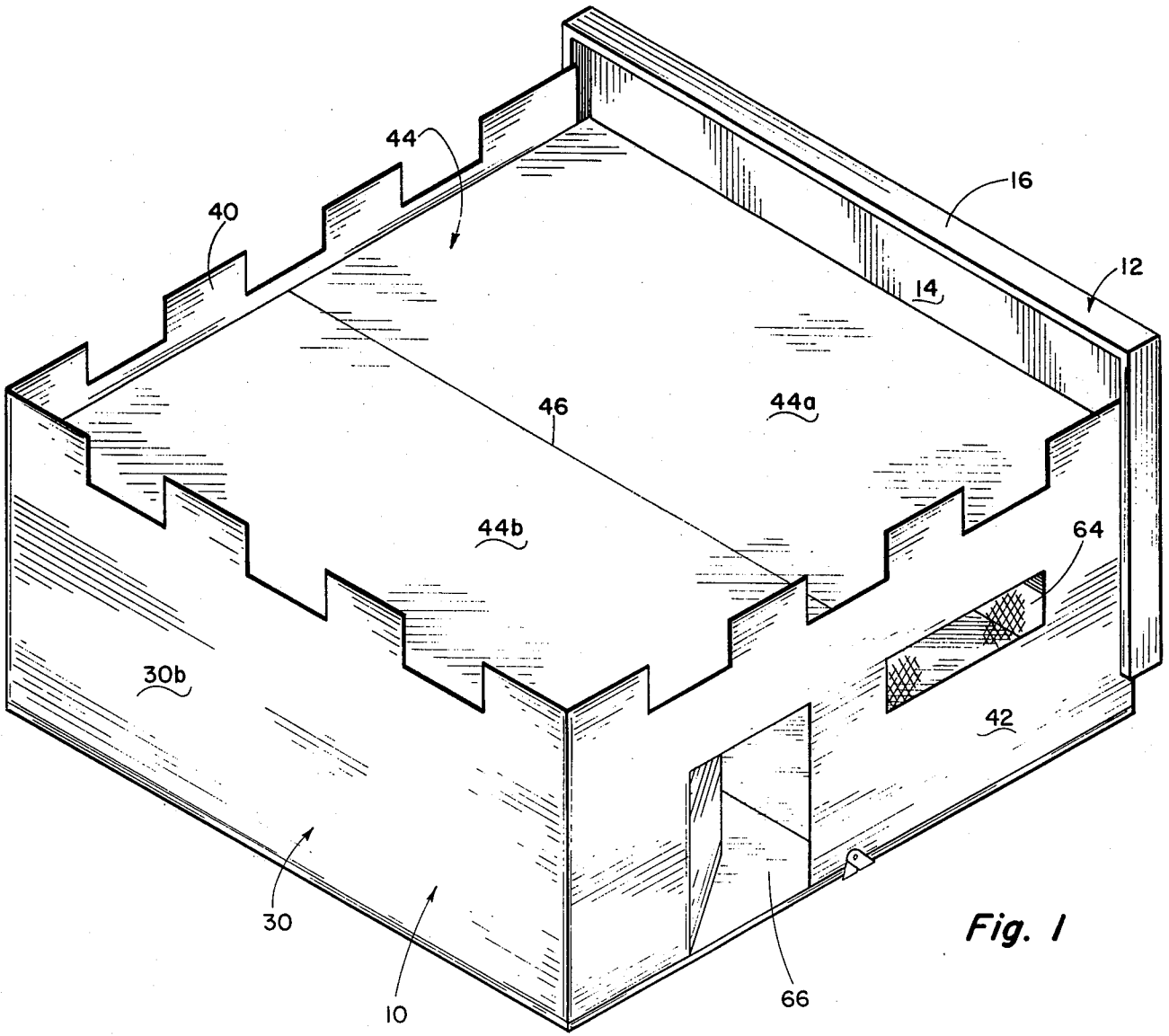
FIG. 1 is a perspective view of a playhouse, or the like, embodying the invention, and depicting the apparatus in an assembled or erected position.

Referring to the drawings in detail, reference character 10 generally indicates a building structure of the type normally used as a child's playhouse, or the like, and comprises a main storage box element 12 including a substantially flat plate member 14 having a substantially perpendicularly extending peripheral flange 16 extending around the upper edge and two end edges thereof as clearly shown in the drawings, and for a purpose as will be hereinafter set forth. The box structure 12 may be mounted directly on the wall 18 of a room, such as a child's playroom wall, a basement wall, a garage wall, or the like, in any suitable manner, such as by nails (not shown), screws (not shown), or the like, and is preferably disposed with the lower edge 20 thereof substantially adjacent the upper edge of the usual baseboard 22, as particularly shown in FIG. 2. In the event the wall 18 is not provided with a baseboard, the lower edge 20 of the plate 14 should be spaced from the juncture between the wall and the floor of the room in order to provide clearance for the assembly and disassembly of the device 10. The plate 14 subsequently functions as one sidewall of the house structure 10, as will be hereinafter set forth.

A sheet or plate member 24 of a length and width substantially equal to the length and width of the plate 14 is pivotally secured to the lower edge 20 of the plate 14 in any suitable manner, such as by a pair of spaced hinge members 26 and 28. Thus, the sheet 22 may be positioned against the plate 14 when the housing structure 10 is in a collapsed or stored position, and may be moved to a position substantially perpendicular with respect thereto in the assembled or erected condition of the device 10.

A second sheet or plate member 30 is pivotally secured to one edge 32 of the plate 24 oppositely disposed from the edge 20 in any suitable manner, such as be a pair of spaced hinges 34 and 36. The plate or sheet 30 is dimensioned in such a manner that the width thereof is substantially equal to the length of sheet 24 and the length of the sheet 30 is substantially twice as long as the width of the sheet 24. In addition, the sheet 30 is provided with a hinge or fold line 38 extending transversely thereacross and centrally disposed with respect to the length thereof whereby the sheet 30 may be separated into two half-sections 30*a* and 30*b*, each half-section being of a planar size substantially equal to the planar size of the plate or sheet 24. Thus, the two half-sections may be folded together to provide an element of a size substantially equal in planaer dimensions to the planar dimensions of the sheet 24, for a purpose as will be hereinafter set forth.

Figure 8:
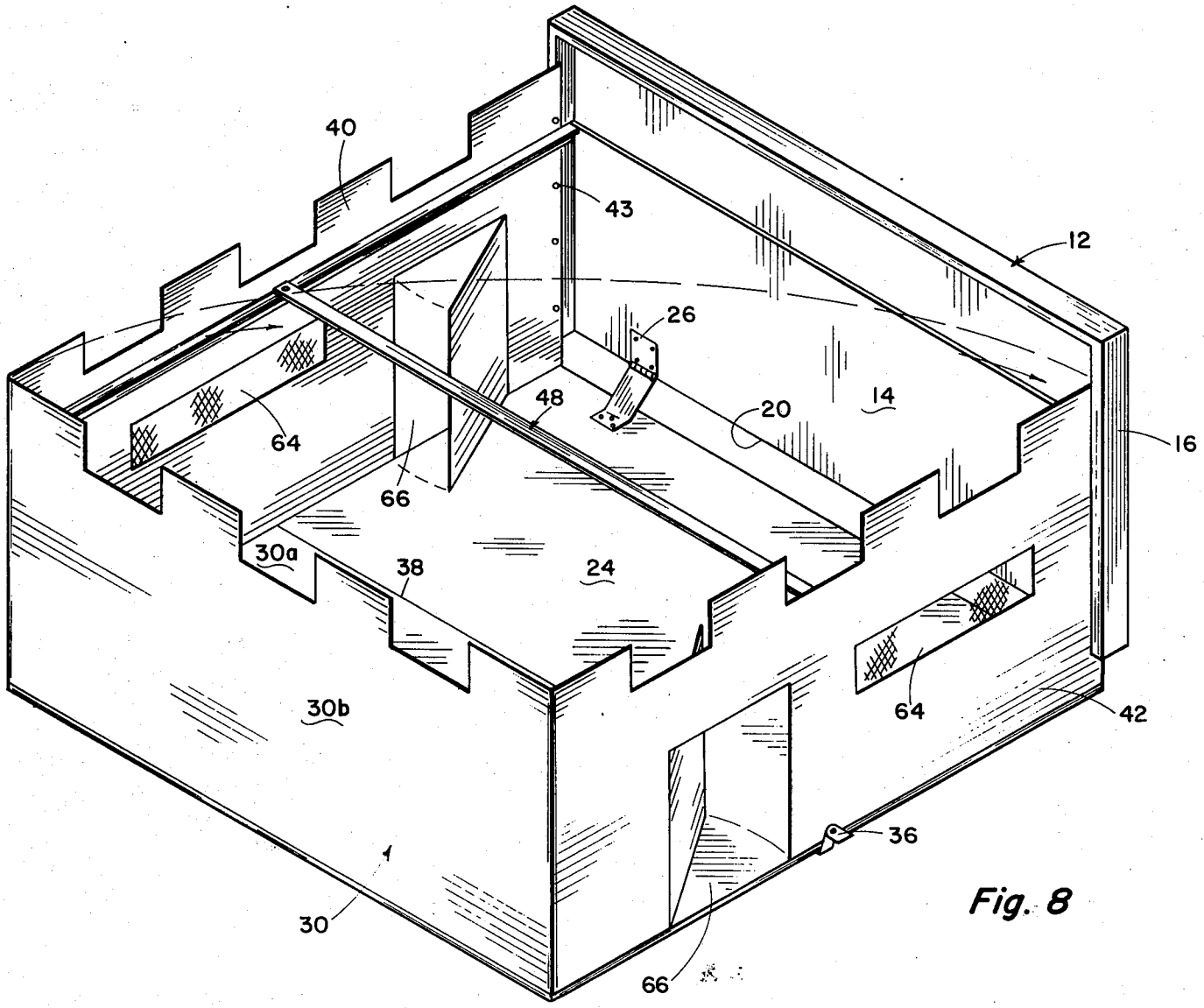
FIG. 8 is a perspective view of a substantially completely assembled structure embodying the invention, and depicted without a roof structure provided thereon.

The sheet 30 is also provided with a pair of oppositely disposed flap members 40 and 42 suitably secured to the opposite ends of the half-section 30*b* in such a manner that the flap 42 may be folded against the inwardly directed surface of the half-section 30*b* and the flap 40 may be folded against the flap 42 in the collapsed position of the device 10, and may be extended to positions substantially perpendicular to the plane of the half-section 30*b* and mutually parallel in the assembled position of the device 10. In the assembled position of the device 10, the plates 14, 30*b*, 40 and 42 form the four sidewalls of the housing structure 10 and the free ends of the walls 40 and 42 may be snapped in position against the flange 16 as shown at 43 in FIG. 8. Of course, the flaps 40 and 42 may be hingedly secured to the ends of the half-section 30*b*, if desired, or may be integral therewith and provided with a hinge line or fold line at the juncture therebetween for facilitating the folding and unfolding of the device 10.

An independent roof sheet 44 may be provided for the assembled device 10, if desired. The sheet 44 is preferably rectangular and of a size whereby one dimension thereof is substantially equal to the length of the sheets 14 and 24, and the other dimension thereof substantially equal to the combined widths of the sheet 24 and the half-section 30*a*, and thus may be easily positioned over the upper portion of the assembled structure 10 in order to enclose the housing, if desired. It is preferable that the roof plate 44 be provided with a centrally disposed transversely extending hinge or fold line 46 whereby the sheet 44 may be folded into two half-sectons 44*a* and 44*b*, each section being substantially the same planar size as the sheet 24. In addition, it may be desirable to provide an independent rail-type structure generally indicated at 48 in FIG. 8 for facilitating supporting of the roof 44 on the assembled housing 10, as will be hereinafter set forth. The rail-type structure 48 may be bolted in position, or alternatively, suitable grooves (not shown) may be provided on the inwardly directed faces of the sidewalls 40 and 42 whereby the rail assembly 48 may be "snapped" in position when the apparatus 10 is in the assembled position. When the roof 44 and rails 48, which are preferably independent and separable elements, may stored in the box-like structure 14 when the device 10 is in the stored position.

Figure 2:
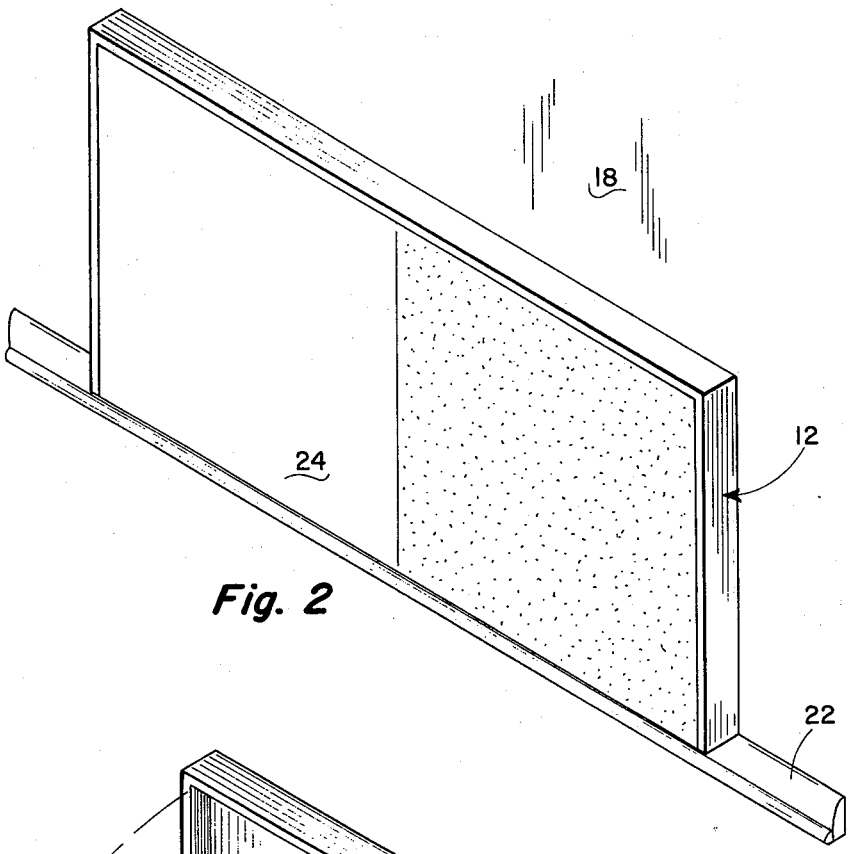
FIG. 2 is a perspective view of a playhouse, or the like, embodying the invention and depicted in a completely collapsed position for storage thereof as mounted on a wall.

In order to store the apparatus 10 when not in use, the flaps 40 and 42 may be disengaged from the connection with the flange 16 and folded against the inwardly directed surface of the half-section 30*b*. The half-section 30*b* may then be folded against the half-section 30, and the entire portion 30, thus folded, may be moved into a position adjacent the sheet or plate 24. The plate 24 may then be moved about the hinges 26 and 28 to a position adjacent the plate 14, whereby the entire apparatus 10 will be disposed within the confines of the frame 16 as shown in FIG. 2. The roof 44 and rails 48 may also be stored with the apparatus 10, and within the confines of the frame 16. In order to retain the collapsed device 10 in position within the frame 16, suitable hasp means (not shown), a rotatable wing nut (not shown), or other locking elements (not shown) may be provided on the flange 16 for selective engagement with the exposed surface of the sheet 24.

From an inspection of FIG. 2 is will be apparent that the collapsed device 10 is completely out of the way when not in use, and yet maintained at a convenient location. The exposed surface of the sheet 24 may be decoratively covered in order to enhance the overall appearance of the room, or the exposed surface thereof may be in the form of a chalk board, magnetic board, peg board, or the like, which may be functional at times when it is not desired to use the device 10 as a playhouse.

Figure 3:
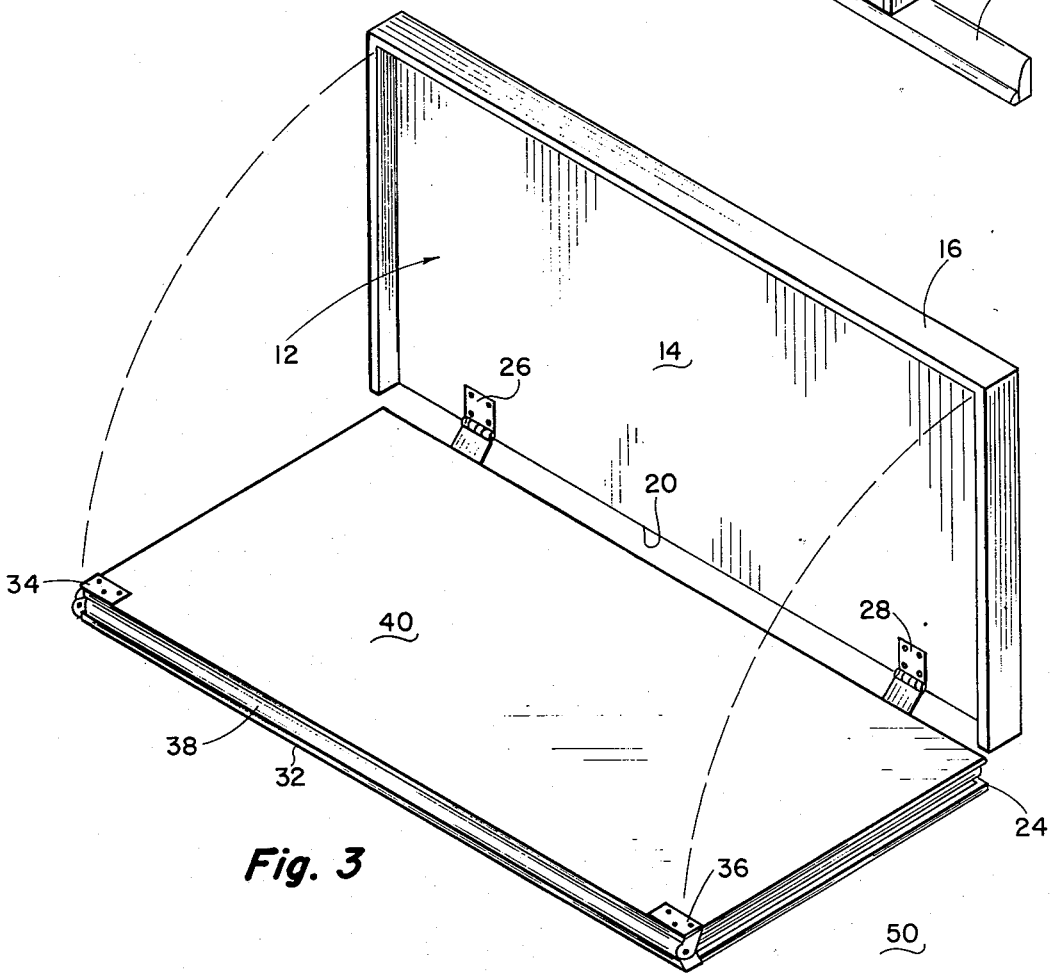
FIG. 3 is a view similar to FIG. 1 depicting the structure in the initial step of assembly thereof from a collapsed position toward an assembled position.
Figure 4:
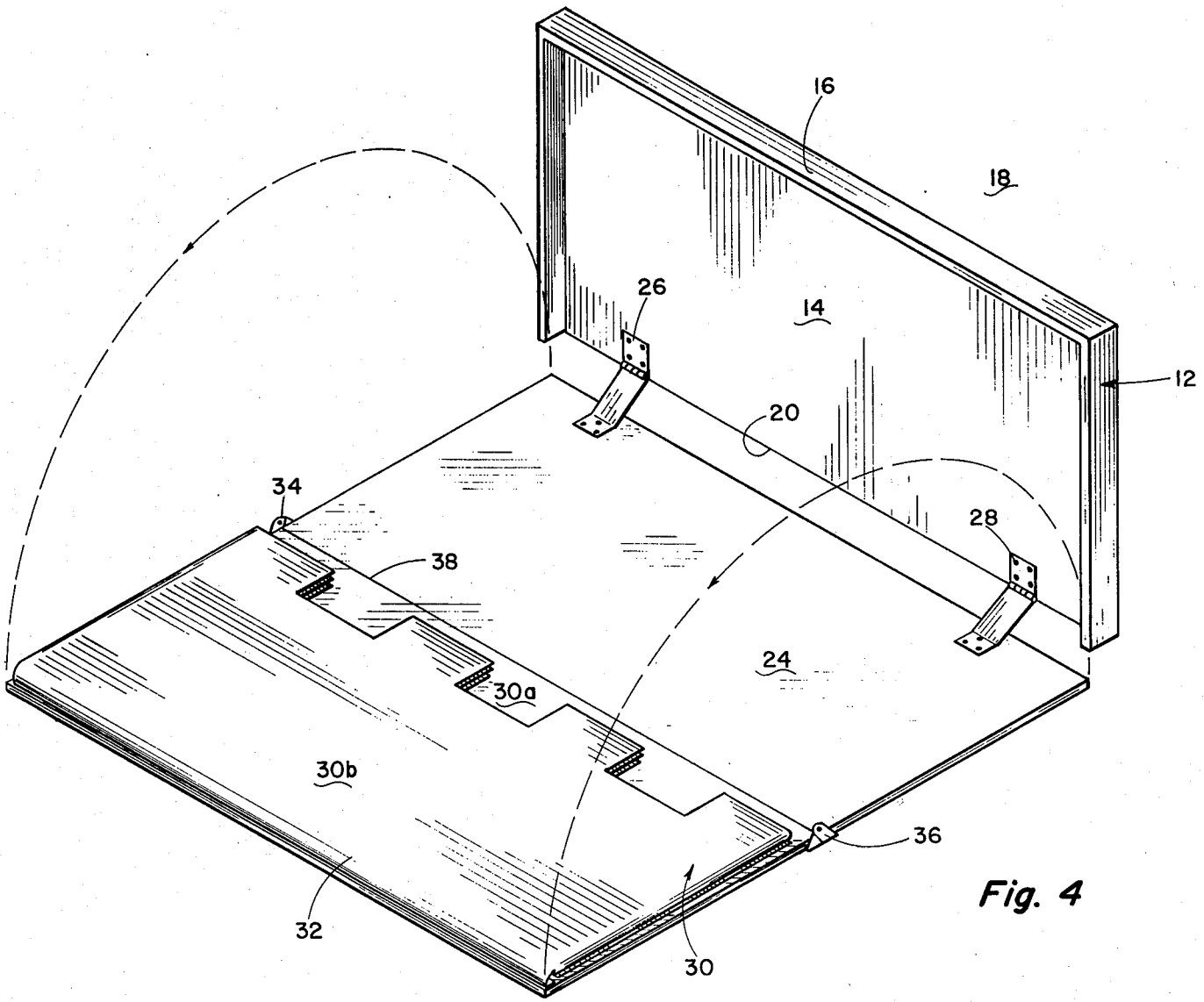
FIG. 4 is a view similar to FIG. 3 depicting the next succeeding step in the assembly of the structure embodying the invention.

In order to assemble the device 10 into the playhouse as shown in FIG. 1, the latchine elements (not shown) may be manipulated for releasing the engagement with the sheet 24 whereby the sheet 24 may be pivoted about the hinges 26 and 28 to a position against the floor 50 of the room wherein the device 10 is installed, as shown in FIG. 3. The arrangement of the hinges 26 and 28 is such that even though the edge 20 is spaced above the floor, the sheet 24 will lay against the floor in the extended position of the sheet 24. The element 30 may then be pivoted about the hinges 34 and 36 to position the half-section 30*a* substantially coplanar with respect to the sheet 24, as shown in FIG. 4. The sheet 24 and half-section 30*a* cooperate to form a floor for the assembled housing structure 10.

Figure 5:
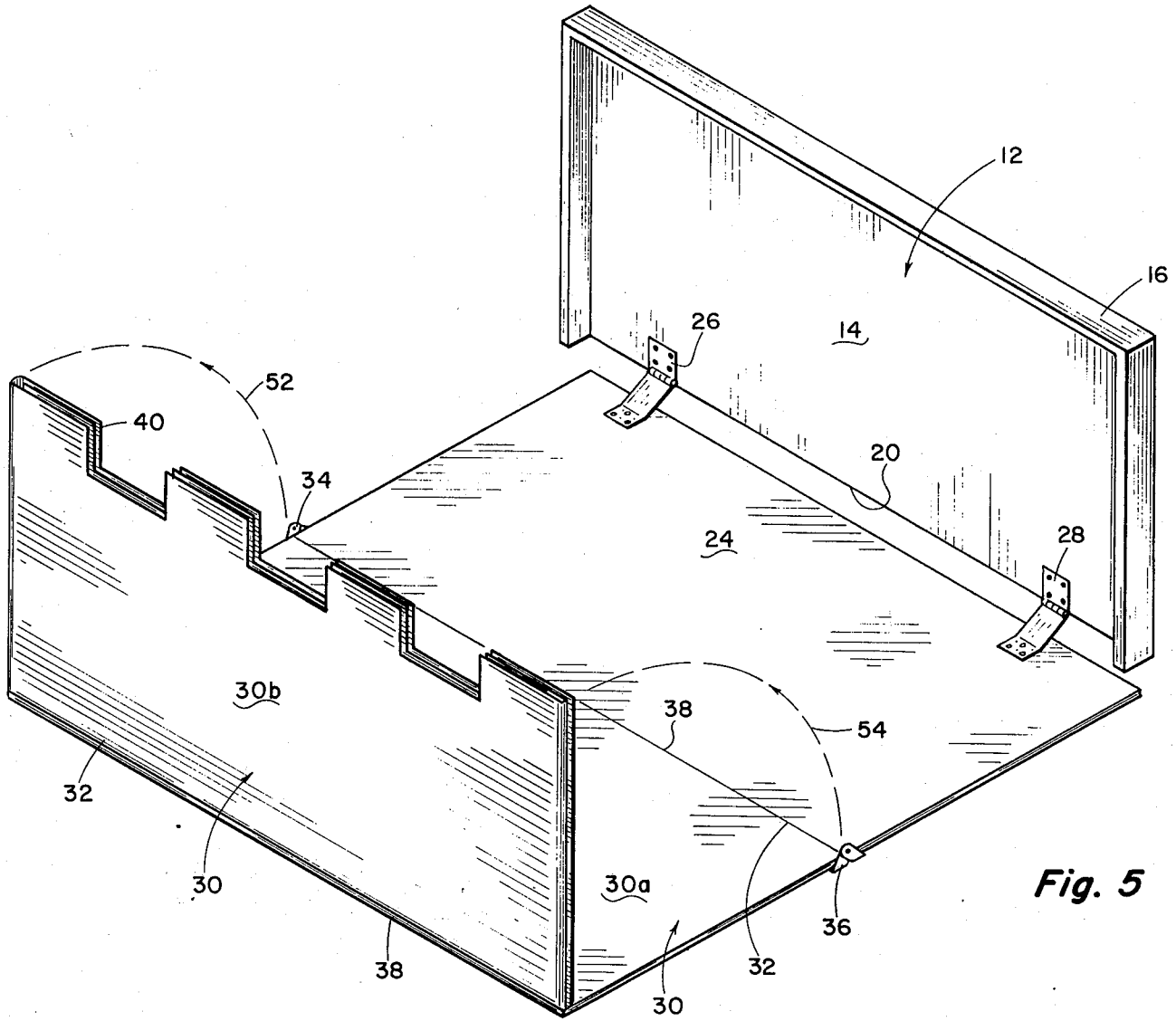
FIG. 5 is a view similar to FIG. 4 showing the next succeeding step in the assembly of the structure.
Figure 6:
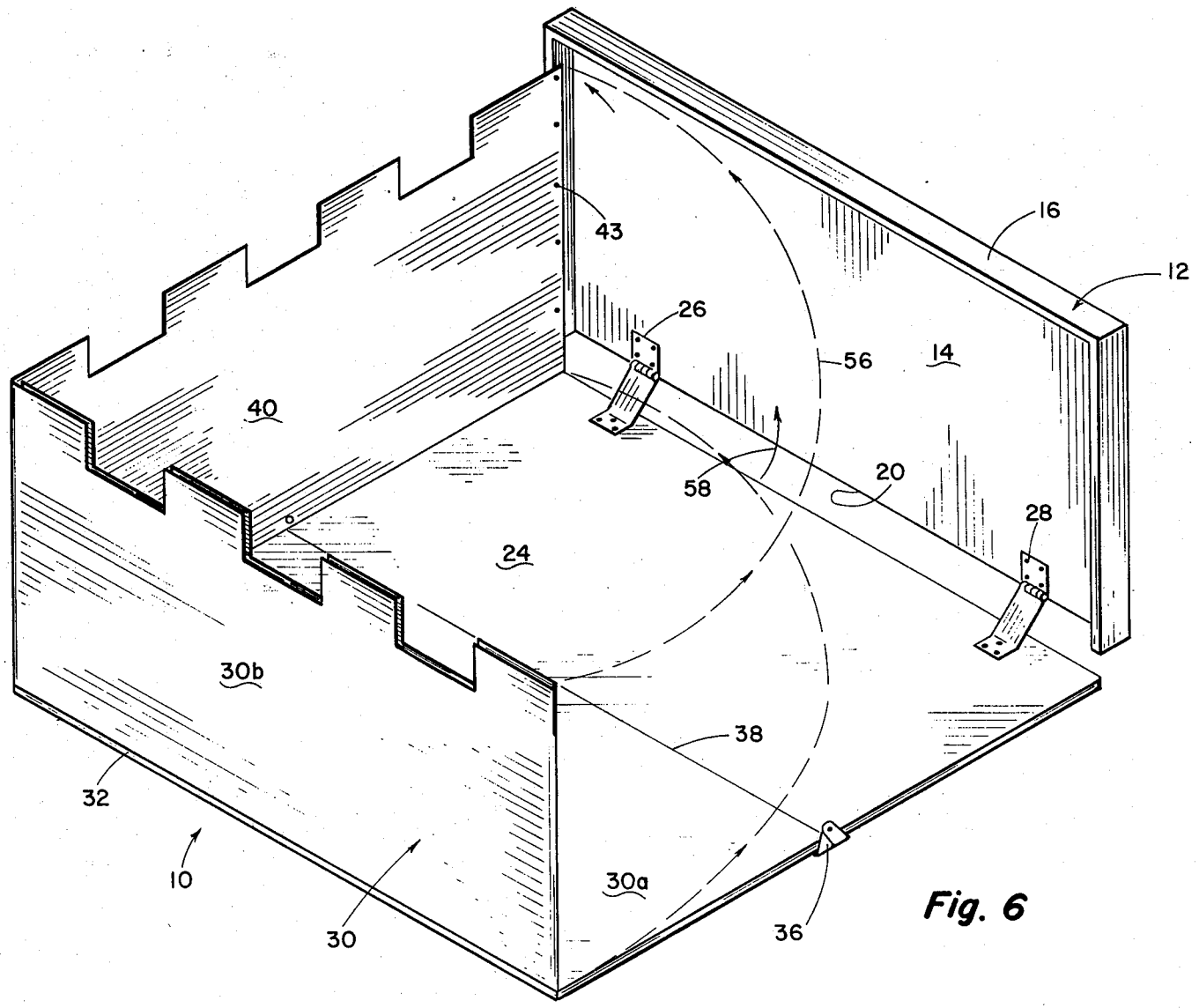
FIG. 6 is a view similar to FIG. 5 depicting the next succeeding step in the assembly of the structure.
Figure 7:
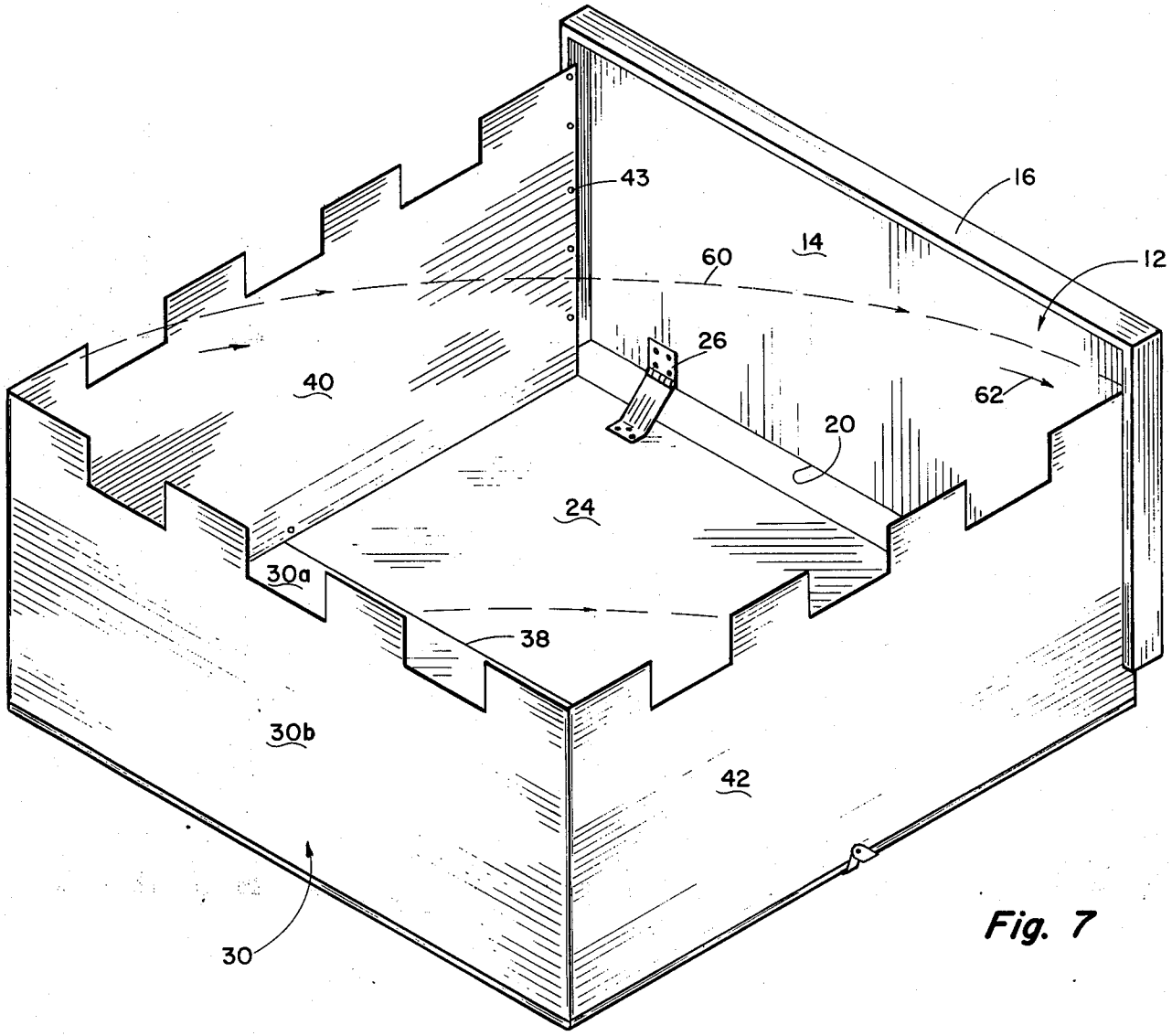
FIG. 7 is a view similar to FIG. 6 depicting the next succeeding step in the assembly of the structure.

From the position shown in FIG. 4, the half-section 30*b* may be raised about the hinge or fold line 32 to a substantially upright or vertical position as shown in FIG. 5, and as indicated by the broken arcuate lines 52 and 54. Next, the flap 40 may be unfolded from its position against the flap 42 and moved through an arc as indicated by the broken line 56 and in the direction indicated by the arrows 58. The free end of the flap 40 may then be engaged with the inwardly directed surface of the flange 16 as shown at 43 in order to securely retain the flap 40 in the assembled position. The flap 42 may then be similarly unfolded and moved through the arc indicated by the broken line 60 and in the direction shown by the arrows 62 for a similar engagement with the flange 16 oppositely disposed with respect to the flap 40. In this manner, the sheet 14, half-section 30*b* and flaps 40 and 42 form the four sidewalls for the assembled housing structure 10.

The sidewalls 30*b*, 40 and 42 may be selectively configured to represent substantially any desired structure for the apparatus 10. For example, as shown herein the overall configuration of the device 10 is that simulating a fort. However, the device 10 may be designed to resemble a castle, ordinary house, or the like, and may be provided with suitable windows 64, doors 66, or the like, to produce the particular structure desired for the playhouse structure.

In the event the assembled structure 10 is to resemble a more conventional or ordinary house, or the like, the roof 44 may be desired. In this instance, the rail structure 48 may be snapped into position and the roof 44 may be placed thereon to provide a completely enclosed assembled structure.

From the foregoing, it will be apparent that the present invention provides a novel collapsible playhouse type structure which may be readily assembled and disassembled to facilitate both the use and storing thereof. The novel structure may be conveniently stored in a substantially permanent box-like arrangement secured directly to a wall wherein the device is to be used. The stored position of the device may render the room more decorative, or may provide an added functional feature for the room.

Whereas the present invention has been described in particular relation to the drawings attached hereto, it should be understood that other and further modifications, apart from those shown or suggested herein may be made within the spirit and scope of this invention.

What is claimed is:

1. A collapsible playhouse type structure comprising main storage box means secured to a wall of a room and having the exposed side thereof open to the interior of the room, first plate means hingedly secured to the main storage box means and movable between a storage position within the confines of the storage box and an extended position beyond the open face in the proximity of the surface of the ground and substantially perpendicular with respect to the storage box to provide a half-floor for the playhouse type structure, second plate means hingedly secured to the first plate means along the edge thereof oppositely disposed with respect to the storage box means and movable between a folded position adjacent the first plate means and an extended position providing a second half-floor section substantially co-planar with the extended first plate means, said second plate means including a foldable section attached thereto opposite the first plate means and movable between a collapsed position and a substantially upright position to provide a sidewall for the playhouse type structure, said second plate means also including first and second flap means secured to the opposite ends of the foldable section and movable between positions adjacent the foldable section and positions substantially perpendicular with respect thereto to provide oppositely disposed sidewalls for the playhouse type structure, said flap means removably engagable with said storage box section whereby the storage box section provides a fourth sidewall for the assembled playhouse structure, and said first and second plate means being collapsible for storage within the confines of the storage box means whereby the collapsed playhouse type structure is unobstructive in the room when not in use.

2. A collapsible playhouse type structure as set forth in claim 1 wherein the outer surface of the collapsed playhouse type structure stored within the storage box means is exposed to the interior of the room and is provided with means for adding to the decor of the room.

3. A collapsible playhouse type structure as set forth in claim 1 wherein the outer surface of the collapsed playhouse structure stored within the storage box is exposed to the interior of the room and is provided with means for adding to the utility thereof.

4. A collapsible playhouse type structure as set forth in claim 1 wherein the storage box means comprises a flat sheet member for disposition against the wall of the room, and a substantially perpendicularly extending peripheral flange provided around the upper edge and opposite ends of the flat plate for encasing the collapsed playhouse type structure folded therein and providing said open exposed side for said storage box means.

5. A collapsible playhouse type structure as set forth in claim 4 wherein the first plate means is hingedly secured to the lower edge of the flat sheet member.

6. A collapsible playhouse type structure comprising main storage box means secured to a wall of a room and having the exposed side thereof open to the interior of the room, first plate means hingedly secured to the main storage box means and movable between a storage position within the confines of the storage box and an extended position beyond the open face in the proximity of the surface of the ground and substantially perpendicular with respect to the storage box to provide a half-floor section for the playhouse type structure, second plate means hingedly secured to the first plate means along the edge thereof oppositely disposed with respect to the storage box means and movable between a folded position adjacent the first plate means and an extended position providing a second half-floor section substantially co-planar with the extended first plate means, said second plate means including a foldable section attached thereto opposite the first plate means and movable between a collapsed position and a substantially upright position to provide a sidewall for the playhouse type structure, said second plate means also including first and second flap means secured to the opposite ends of the foldable section and movable between positions adjacent the foldable section and positions substantially perpendicular with respect thereto to provide oppositely disposed sidewalls for the playhouse type structure, said flap means being removably engagable with said storage box section whereby the storage box section provides a fourth sidewall for the assembled playhouse type structure, and said first and second plate means being collapsible for storage within the confines of the storage box means whereby the collapsed playhouse type structure is unobstructive in the room when not in use, and including an independent roof means for the assembled playhouse type structure for completely enclosing the assembled structure.

7. A collapsible playhouse type structure as set forth in claim 6 wherein the roof means comprises a substantially flat rectangular sheet foldable into a size complementary with the size of the storage box means for storage therein when not in use.

8. A collapsible playhouse type structure comprising main storage box means secured to a wall of a room and having the exposed side thereof open to the interior of the room, first plate means movable between a storage position within the confines of the storage box and an extended position beyond the open face in the proximity of the surface of the ground and substantially perpendicular with respect to the storage box to provide a half-floor for the playhouse type structure, second plate means hingedly secured to the first plate means along the edge thereof oppositely disposed with respect to the storage box means and movable between a folded position adjacent the first plate means and an extended position providing a second half-floor section substantially co-planar with the extended first plate means, said second plate means including a foldable section attached thereto opposite the first plate means and movable between a collapsed position and a substantially upright position to provide a sidewall for the playhouse type structure, said second plate means also including first and second flap means secured to the opposite ends of the foldable section and movable between positions adjacent the foldable section and positions substantially perpendicular with respect thereto to provide oppositely disposed sidewalls for the playhouse type structure, said flap means being removably engagable with said storage box section whereby the storage box section provides a fourth sidewall for the assembled playhouse structure, and said first and second plate means being collapsible for storage within the confines of the storage box means whereby the collapsed playhouse type structure is unobstructive in the room when not in use, and including an independent roof means for the assembled playhouse type structure for completely enclosing the assembled structure, and further including independent support means engagable with the sidewalls of the assembled playhouse type structure for supporting the roof means.

* * * * *